US005502935A

United States Patent [19]

Demmer

[11] Patent Number: 5,502,935

[45] Date of Patent: Apr. 2, 1996

[54] ROOF TO CEILING SKYLIGHT APPARATUS

[76] Inventor: Albert J. Demmer, 611 Bayless, Euless, Tex. 76040

[21] Appl. No.: 276,414

[22] Filed: Jul. 18, 1994

[51] Int. Cl.[6] ..... E04B 7/18

[52] U.S. Cl. ..... 52/200; 52/199; 52/204.1; 52/22

[58] Field of Search ..... 52/199, 200, 201, 52/204.1, 207, 213, 22

[56] References Cited

U.S. PATENT DOCUMENTS

| | | | |
|---|---|---|---|
| D. 328,795 | 8/1992 | Yamaguchi et al. . | |
| 4,610,116 | 9/1986 | Schulz . | |
| 4,733,505 | 3/1988 | Van Dame | 52/200 X |
| 4,788,804 | 12/1988 | Haas . | |
| 4,809,468 | 3/1989 | Bareiss | 52/200 X |
| 4,823,525 | 4/1989 | Roberts et al. . | |
| 4,916,872 | 4/1990 | Young | 52/200 |
| 5,044,133 | 9/1991 | Sampson et al. . | |
| 5,099.622 | 3/1992 | Sutton . | |

*Primary Examiner*—Kien T. Nguyen

[57] ABSTRACT

A new and improved roof to ceiling skylight apparatus is provided for conveying light from outside a roof to inside a room. The apparatus includes a roof-mounted skylight module which is adapted to be mounted in a roof aperture and which is capable of receiving light from outside a roof. A ceiling-mounted translucent fixture module is adapted to be mounted in a ceiling aperture and is capable of conveying light to inside a room. A flexible, tubular light conveyance module is adapted to be connected between the roof-mounted skylight module and the ceiling-mounted translucent fixture module and is provided for conveying light received from outside the roof, through the roof-mounted skylight module, through the flexible, tubular light conveyance module, through the ceiling-mounted translucent fixture module, and to inside the room. The flexible, tubular light conveyance module includes a plurality of pleats which facilitate bending of the flexible, tubular light conveyance module. The flexible, tubular light conveyance module includes an inner wall, an outer wall, and a quantity of an insulation material located between the inner wall and the outer wall. The inner wall of the flexible, tubular light conveyance module is white to facilitate light reflection within the flexible, tubular light conveyance module from the inner wall. The insulation material includes injected foam material. The flexible, tubular light conveyance module includes a plurality of microperforations which permit moisture to escape from an interior portion of the flexible, tubular light conveyance module.

10 Claims, 3 Drawing Sheets

ROOF TO CEILING SKYLIGHT APPARATUS

BACKGROUND OF THE INVENTION

1. Field of the Invention

The present invention relates generally to a skylight device and, more particularly, to a skylight device that conveys light from an exterior roof to an interior ceiling.

2. Description of the Prior Art

The conveying of outdoor light into an interior room through a roof-mounted window or skylight is well known in the art. In a first type of skylight system, a translucent skylight is fixed to a roof, and a portion of the ceiling of the interior room opens directly to the roof-mounted skylight. Such skylight constructions have a significant disadvantage in requiring doing without ceiling insulation from the portion of the ceiling that receives light from the skylight. In this respect, it would be desirable if a skylight construction were provided which did not do without insulation from a portion of the ceiling that receives light from a roof-mounted skylight.

Another disadvantage associated with the first type of skylight system is the susceptibility of water leaks from the skylight into the room during rain storms. The same susceptibility to water leaks can occur from melting snow. In this respect, it would be desirable if a skylight construction were provided which reduced the susceptibility of water leaks from a skylight into a room below the skylight.

Yet another disadvantage of the first type of skylight system is the exposure of the room below to the outdoor weather when the roof-mounted skylight is broken or subject to repairs. In this respect, it would be desirable if a skylight construction were provided which did not subject a room below to outdoor weather when a roof-mounted skylight is broken or subject to repairs.

In a second type of skylight system, a skylight is mounted on a roof, a translucent ceiling fixture is mounted on a room ceiling, and a rigid, insulated light conveying shaft is constructed to extend between the roof-mounted skylight and the translucent ceiling-mounted fixture. Construction of the rigid, insulated light conveying shaft requires quite a bit of measuring, cutting, and installation skills. Moreover, often the roof-mounted skylight cannot be placed directly above the ceiling-mounted translucent fixture. In such a case, the rigid, insulated light conveying shaft must be constructed to have angular bends. In addition, the roof-mounted skylight may be placed on a sloped roof, and the ceiling-mounted translucent fixture would most generally be placed on a horizontal ceiling. Therefore, the rigid, insulated light conveying shaft from the roof-mounted skylight to the ceiling-mounted translucent fixture must be sloped at one end and horizontal at the other end.

In view of these above-mentioned considerations, it would be desirable if a skylight construction were provided which avoided the construction of a rigid, insulated light conveying shaft from a roof-mounted skylight to a ceiling-mounted translucent fixture. In addition, it would be desirable if a skylight construction were provided which avoided the construction of angular bends in a rigid, insulated light conveying shaft constructed between a roof-mounted skylight that is not placed directly above a ceiling-mounted translucent fixture. Furthermore, it would be desirable if a skylight construction were provided which avoided the construction of a rigid, insulated light conveying shaft constructed between a sloped-roof-mounted skylight and a horizontal-ceiling-mounted translucent fixture.

Another disadvantage in constructing a rigid, insulated light conveying shaft between a roof-mounted skylight and a ceiling-mounted translucent fixture is the extensive amount of time required to construct the rigid, insulated light conveying shaft. Extensive amounts of time translate into expensive amounts of money when professional skylight installers are employed. In this respect, it would be desirable if a skylight construction which permits installation of a light conveyance between a roof-mounted skylight and a ceiling-mounted translucent fixture in much less time than installation of a rigid, insulated light conveying shaft.

A conventional rigid, insulated light conveying shaft is generally constructed from materials, such as sheetrock, that generally need to be treated and painted before the job is considered complete. In this respect, it would be desirable if a skylight construction were provided which did not require painting of the light conveyance from the roof-mounted skylight to the ceiling-mounted translucent fixture.

In the second type of skylight system mentioned above, a standardized roof-mounted skylight may be supplied, and a standardized ceiling-mounted translucent fixture may also be supplied. However, the light conveyance between the roof-mounted skylight and the ceiling-mounted translucent fixture must be constructed in a customized way. In this respect, it would be desirable if a skylight construction were provided which eliminated the need for a customized construction of a light conveyance between a roof-mounted skylight and a ceiling-mounted translucent fixture. By eliminating the need for a customized construction of the light conveyance, a standardized kit can be provided that includes a standardized light conveyance along with a standardized roof-mounted skylight and a standardized ceiling-mounted translucent fixture.

Throughout the years, a number of innovations have been developed relating to skylight constructions, and the following U.S. Pat. Nos. are representative of some of those innovations: 4,610,116; 4,788,804; 4,823,525; 5,044,133; and Des. 328,795. More specifically, U.S. Pat. Nos. 4,610,116, 4,788,804, 4,823,525, and 5,044,133 relate to roof-mounted skylights. They do not relate to ceiling-mounted translucent fixtures. U.S. Pat. No. Des. 328,795 relates to a ceiling-mounted translucent fixture and not to a roof-mounted skylight.

Thus, while the foregoing body of prior art indicates it to be well known to use roof-mounted skylights, ceiling-mounted translucent fixtures, and customized constructions of light conveyances between the two, the prior art described above does not teach or suggest a roof to ceiling skylight apparatus which has the following combination of desirable features: (1) does not do without insulation from a portion of the ceiling that receives light from the skylight; (2) reduces the susceptibility of water leaks from a skylight into a room below the skylight; (3) does not subject a room below a skylight to outdoor weather when a roof-mounted skylight is broken or subject to repairs; (4) avoids the construction of a rigid, insulated light conveying shaft from a roof-mounted skylight to a ceiling-mounted translucent fixture; (5) avoids the construction of angular bends in a rigid, insulated light conveying shaft constructed between a roof-mounted skylight that is not placed directly above a ceiling-mounted translucent fixture; (6) avoids the construction of a rigid, insulated light conveying shaft between a sloped-roof-mounted skylight and a horizontal-ceiling-mounted translucent fixture; (7) permits installation of a light conveyance between a roof-mounted skylight and a ceiling-mounted translucent fixture in much less time than installation of a rigid, insulated light conveying shaft; (8) does not require painting of the light conveyance from the roof-mounted skylight to the ceiling-mounted translucent fixture; (9) eliminates the need for a customized construction of a light conveyance between a roof-mounted skylight and a ceiling-mounted translucent fixture; and (10) provides a standardized skylight kit that includes a standardized light conveyance along with a standardized roof-mounted skylight and a standardized ceiling-mounted translucent fixture. The foregoing desired characteristics are provided by the unique roof to ceiling skylight apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved roof to ceiling skylight apparatus for conveying light from outside a roof to inside a room. The roof to ceiling skylight apparatus includes a roof-mounted skylight module which is adapted to be mounted in a roof aperture and which is capable of receiving light from outside a roof. A ceiling-mounted translucent fixture module is adapted to be mounted in a ceiling aperture and is capable of conveying light to inside a room. A flexible, tubular light conveyance module is adapted to be connected between the roof-mounted skylight module and the ceiling-mounted translucent fixture module and is provided for conveying light received from outside the roof, through the roof-mounted skylight module, through the flexible, tubular light conveyance module, through the ceiling-mounted translucent fixture module, and to inside the room.

The roof-mounted skylight module includes a translucent cap assembly. A cap-receiving assembly supports the translucent cap assembly. The cap-receiving assembly includes an outer dimension which is greater than an inner dimension of the roof aperture. A roof-traversing assembly supports the cap-receiving assembly. The roof-traversing assembly includes an outer dimension that is equal to or less than the inner dimension of the roof aperture. The roof-traversing assembly includes a free distal end portion that is adapted to connect to the flexible, tubular light conveyance module.

The distal end portion of the roof-traversing assembly includes a plurality of ridges adapted to facilitate connection of the roof-traversing assembly to the flexible, tubular light conveyance module. The ceiling-mounted translucent fixture module includes a ceiling-traversing assembly adapted for fitting into the ceiling aperture. A free distal end portion is connected to the ceiling-traversing assembly and is adapted to be connected to the flexible, tubular light conveyance module.

The free distal end portion of the ceiling-mounted translucent fixture module includes a plurality of ridges adapted to facilitate connection of the ceiling-mounted translucent fixture module to the flexible, tubular light conveyance module. A transition portion is connected between the ceiling-traversing assembly and the free distal end portion of the ceiling-mounted translucent fixture module.

The flexible, tubular light conveyance module includes a plurality of pleats which facilitate bending of the flexible, tubular light conveyance module. The flexible, tubular light conveyance module includes an inner wall portion, an outer wall portion, and a quantity of an insulation material located between the inner wall portion and the outer wall portion. The inner wall portion of the flexible, tubular light conveyance module is white to facilitate light reflection within the flexible, tubular light conveyance module from the inner wall portion. The insulation material includes injected foam material. The flexible, tubular light conveyance module includes a plurality of microperforations which permit moisture to escape from an interior portion of the flexible, tubular light conveyance module.

The above brief description sets forth rather broadly the more important features of the present invention in order that the detailed description thereof that follows may be better understood, and in order that the present contributions to the art may be better appreciated. There are, of course, additional features of the invention that will be descried hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved roof to ceiling skylight apparatus which has all of the advantages of the prior art and none of the disadvantages.

It is another object of the present invention to provide a new and improved roof to ceiling skylight apparatus which may be easily and efficiently manufactured and marketed.

It is a further object of the present invention to provide a new and improved roof to ceiling skylight apparatus which is of durable and reliable construction.

An even further object of the present invention is to provide a new and improved roof to ceiling skylight apparatus which is susceptible of a low cost of manufacture with regard to both materials and labor, and which accordingly is then susceptible of low prices of sale to the consuming public, thereby making such roof to ceiling skylight apparatus available to the buying public.

Still yet a further object of the present invention is to provide a new and improved roof to ceiling skylight apparatus which does not do without insulation from a portion of the ceiling that receives light from the skylight.

Still another object of the present invention is to provide a new and improved roof to ceiling skylight apparatus that reduces the susceptibility of water leaks from a skylight into a room below the skylight.

Yet another object of the present invention is to provide a new and improved roof to ceiling skylight apparatus which does not subject a room below a skylight to outdoor weather when a roof-mounted skylight is broken or subject to repairs.

Even another object of the present invention is to provide a new and improved roof to ceiling skylight apparatus that avoids the construction of a rigid, insulated light conveying shaft from a roof-mounted skylight to a ceiling-mounted translucent fixture.

Still a further object of the present invention is to provide a new and improved roof to ceiling skylight apparatus which avoids the construction of angular bends in a rigid, insulated light conveying shaft constructed between a roof-mounted skylight that is not placed directly above a ceiling-mounted translucent fixture.

Yet another object of the present invention is to provide a new and improved roof to ceiling skylight apparatus that avoids the construction of a rigid, insulated light conveying shaft between a sloped-roof-mounted skylight and a horizontal-ceiling-mounted translucent fixture.

Still another object of the present invention is to provide a new and improved roof to ceiling skylight apparatus which permits installation of a light conveyance between a roof-mounted skylight and a ceiling-mounted translucent fixture in much less time than installation of a rigid, insulated light conveying shaft.

Yet another object of the present invention is to provide a new and improved roof to ceiling skylight apparatus that does not require painting of the light conveyance from the roof-mounted skylight to the ceiling-mounted translucent fixture.

Still a further object of the present invention is to provide a new and improved roof to ceiling skylight apparatus that eliminates the need for a customized construction of a light conveyance between a roof-mounted skylight and a ceiling-mounted translucent fixture.

Yet another object of the present invention is to provide a new and improved roof to ceiling skylight apparatus which provides a standardized skylight kit that includes a standardized light conveyance along with a standardized roof-mounted skylight and a standardized ceiling-mounted translucent fixture.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
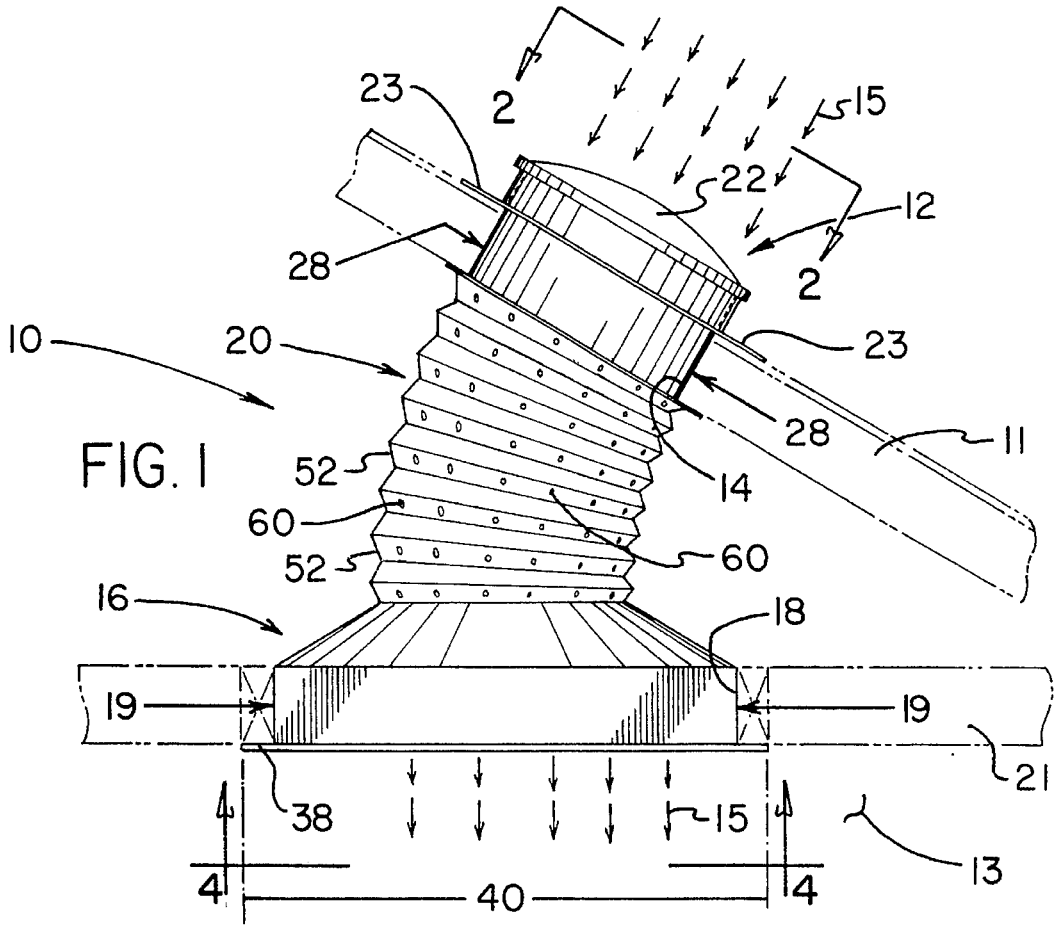
FIG. 1 is a side view showing a preferred embodiment of the roof to ceiling skylight apparatus of the invention in the form of a standardized kit installed between a sloped roof and a horizontal ceiling.
Figure 2:
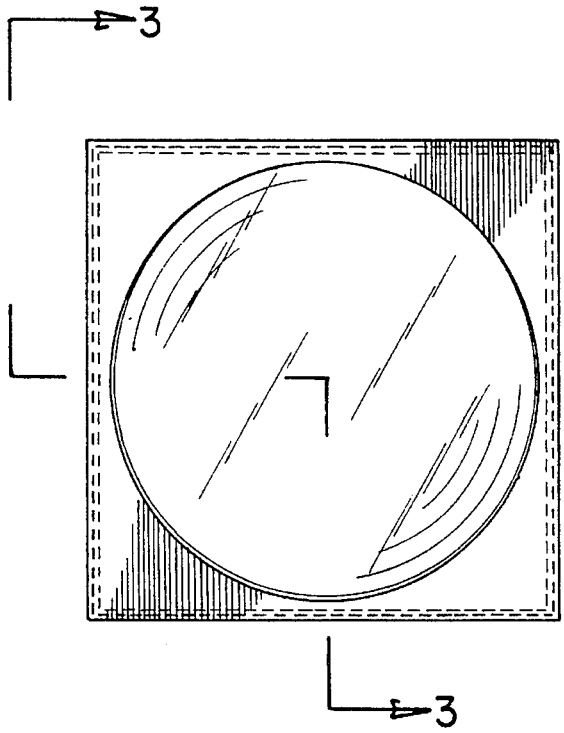
FIG. 2 is an enlarged overhead view of the roof-mounted skylight shown in FIG. 1 taken along line 2—2 in FIG. 1 also showing installed flashing.

With reference to the drawings, a new and improved roof to ceiling skylight apparatus embodying the principles and concepts of the present invention will be described.

Turning initially to FIGS. 1–6, there is shown an exemplary embodiment of the roof to ceiling skylight apparatus of the invention generally designated by reference numeral 10. In its preferred form, roof to ceiling skylight apparatus 10 is provided for conveying light from outside a roof 11 to inside a room 13. The roof to ceiling skylight apparatus 10 includes a roof-mounted skylight module 12 which is adapted to be mounted in a roof aperture 14 and which is capable of receiving light shown as arrows 15 from outside a roof 11. A ceiling-mounted translucent fixture module 16 is adapted to be mounted in a ceiling aperture 18 and is capable of conveying light to inside a room 13. A flexible, tubular light conveyance module 20 is adapted to be connected between the roof-mounted skylight module 12 and the ceiling-mounted translucent fixture module 16 and is provided for conveying light received from outside the roof 11, through the roof-mounted skylight module 12, through the flexible, tubular light conveyance module 20, through the ceiling-mounted translucent fixture module 16, and to inside the room 13.

The roof-mounted skylight module 12 includes a translucent cap assembly 22. A cap-receiving assembly 24 supports the translucent cap assembly 22. The cap-receiving assembly 24 includes an outer dimension 26 which is greater than an inner dimension 28 of the roof aperture 14. A roof-traversing assembly 30 supports the cap-receiving assembly 24. The roof-traversing assembly 30 includes an outer dimension 32 that is equal to or less than the inner dimension 28 of the roof aperture 14. The roof-traversing assembly 30 includes a free distal end portion 34 that is adapted to connect to the flexible, tubular light conveyance module 20.

Preferably, when the roof-mounted skylight module 12 is installed in the roof aperture 14, a flashing curb assembly 23 is used to prevent water seepage from the roof 11 around the roof-traversing assembly 30 of the roof-mounted skylight module 12. The flashing curb assembly 23 includes a vertical portion that fits snugly against the cap-receiving assembly 24 and includes a horizontal portion that fits over adjacent portions of the roof 11 which may include roof shingles.

As shown in FIG. 1, the roof-traversing assembly 30 of the roof-mounted skylight module 12 passes through the roof aperture 14, and one end of the flexible, tubular light conveyance module 20 fits over the distal end portion 34 of the roof-traversing assembly 30. The end of the flexible, tubular light conveyance module 20 can fit snugly against the interior side of the roof 11. Alternatively, the roof aperture 14 can be made sufficiently large so that one end of the flexible, tubular light conveyance module 20 can be connected to the roof-traversing assembly 30 of the roof-mounted skylight module 12 within the confines of the roof aperture 14. In this respect, the end of the flexible, tubular light conveyance module 20 can serve a second function which is as a packing material for packing the space between the roof-traversing assembly 30 of the roof-mounted skylight module 12 and the roof aperture 14.

Figure 3:
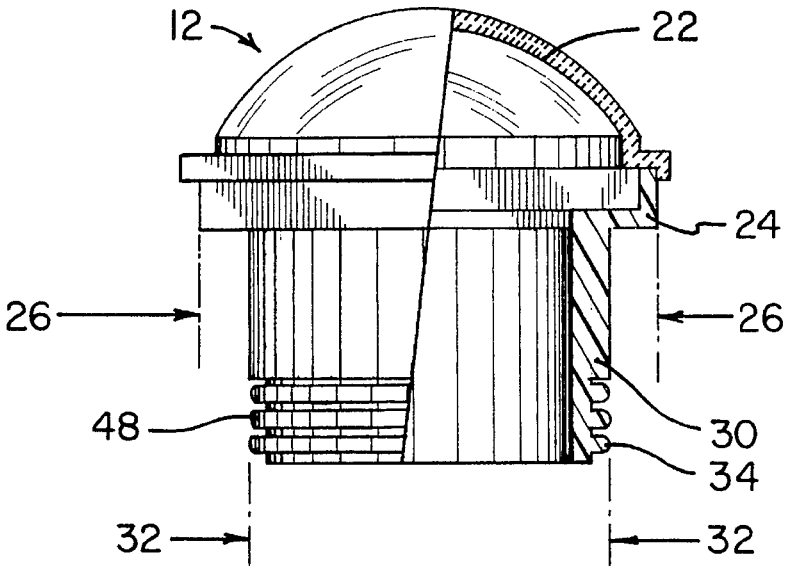
FIG. 3 is a partial side view and partial cross-sectional view of the roof-mounted skylight shown in FIG. 2 taken along line 3—3 of FIG. 2.
Figure 4:
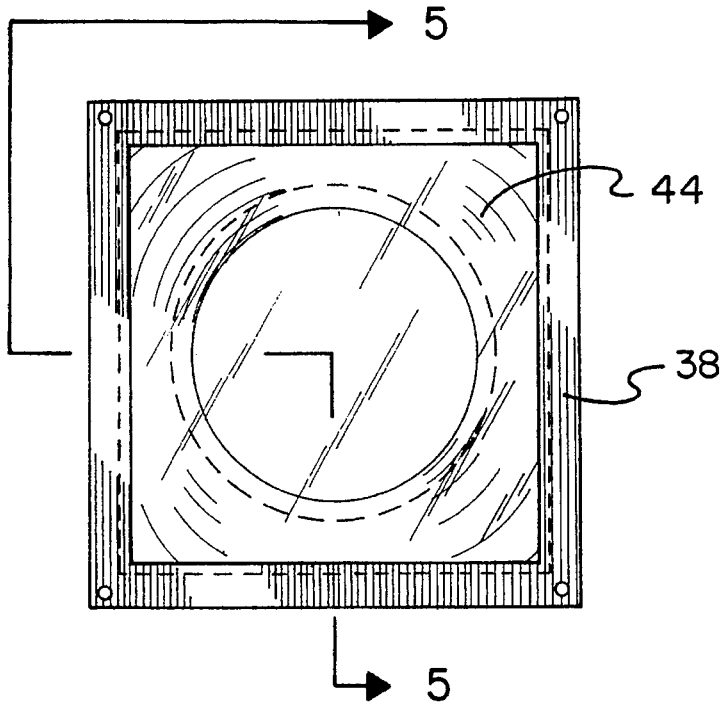
FIG. 4 is a bottom view of the ceiling-mounted translucent fixture shown in FIG. 1 taken along line 4—4 of FIG. 1.

As shown in FIG. 3, the distal end portion 34 of the roof-traversing assembly 30 includes a plurality of ridges 48 adapted to facilitate connection of the roof-traversing assembly 30 to the flexible, tubular light conveyance module 20. The ceiling-mounted translucent fixture module 16 includes a ceiling-traversing assembly 42 adapted for fitting into the ceiling aperture 18. A free distal end portion 36 is connected to the ceiling-traversing assembly 42 and is adapted to be connected to the flexible, tubular light conveyance module 20.

Figure 5:
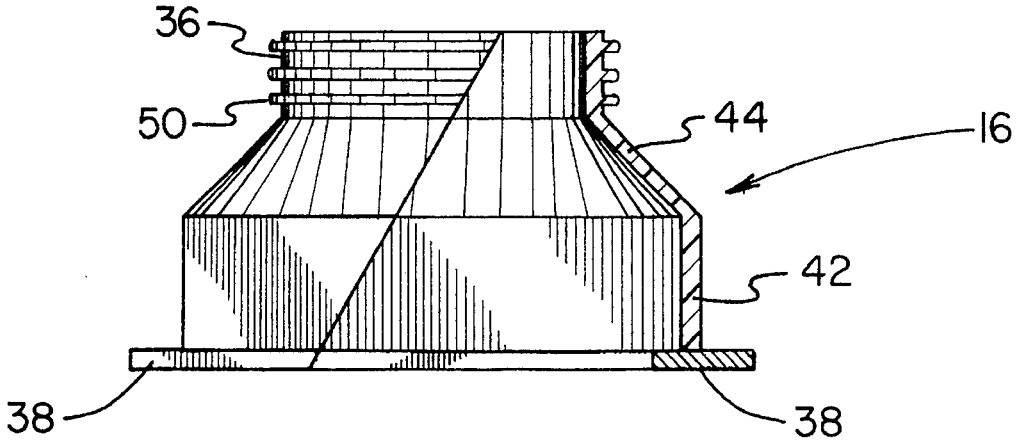
FIG. 5 is a partial side view and partial cross-sectional view of the ceiling-mounted translucent fixture shown in FIG. 4 taken along line 5—5 of FIG. 4.

As shown in FIG. 5, the free distal end portion 36 of the ceiling-mounted translucent fixture module 16 includes a plurality of ridges 50 adapted to facilitate connection of the ceiling-mounted translucent fixture module 16 to the flexible, tubular light conveyance module 20. A transition portion 44 is connected between the ceiling-traversing assembly 42 and the free distal end portion 36 of the ceiling-mounted translucent fixture module 16.

The transition portion 44 enables a ceiling-traversing assembly 42 that has one type or size of cross-sectional profile to be adapted to a flexible, tubular light conveyance module 20 that has another type or size of cross-sectional profile. In another embodiment of the ceiling-mounted translucent fixture module 16, the transition portion 44 can be longer on one side than another side so that the free distal end portion 36 of the ceiling-mounted translucent fixture module 16 leans to one side of the ceiling-mounted translucent fixture module 16. Fasteners can be used to secure the ceiling-traversing assembly 42 of the ceiling-mounted translucent fixture module 16 to the sidewall of the ceiling aperture 18. Such fasteners includes screws, nails, and bolts. Alternatively, a retention flange assembly 38 can be used to secure the ceiling-mounted translucent fixture module 16 to the ceiling 21. The retention flange assembly 38 can also be used as a trim or frame to cover the bottom side of the ceiling-traversing assembly 42 of the ceiling-mounted translucent fixture module 16.

The flexible, tubular light conveyance module 20 includes a plurality of pleats 52 which facilitate bending of the flexible, tubular light conveyance module 20. The pleats 52 almost serve in the capacity of complementary ridges for meshing with the respective ridges 48 of the roof-traversing assembly 30 of the roof-mounted skylight module 12 and the respective ridges 50 of the free distal end portion 36 of the ceiling-mounted translucent fixture module 16. The flexible, tubular light conveyance module 20 can be reinforced with an internal wire, e.g. a wire spiral.

The flexible, tubular light conveyance module 20 includes an inner wall portion 54, an outer wall portion 56, and a quantity of an insulation material 58 located between the inner wall portion 54 and the outer wall portion 56. The inner wall portion 54 of the flexible, tubular light conveyance module 20 is white to facilitate light reflection within the flexible, tubular light conveyance module from the inner wall portion 54. Preferably, the flexible, tubular light conveyance module 20, especially the inner wall portion 54 and the outer wall portion 56, are mildew resistant. The inner wall portion 54 and the outer wall portion 56 may be made from durable, flexible vinyl materials. Similarly, the materials from which the roof-mounted skylight module 12 and the ceiling-mounted translucent fixture module 16 are made may also be plastic materials, in this case rigid plastic materials. The insulation material 58 includes injected foam material, fiberglass or any other suitable, known, flexible insulating material.

Figure 6:
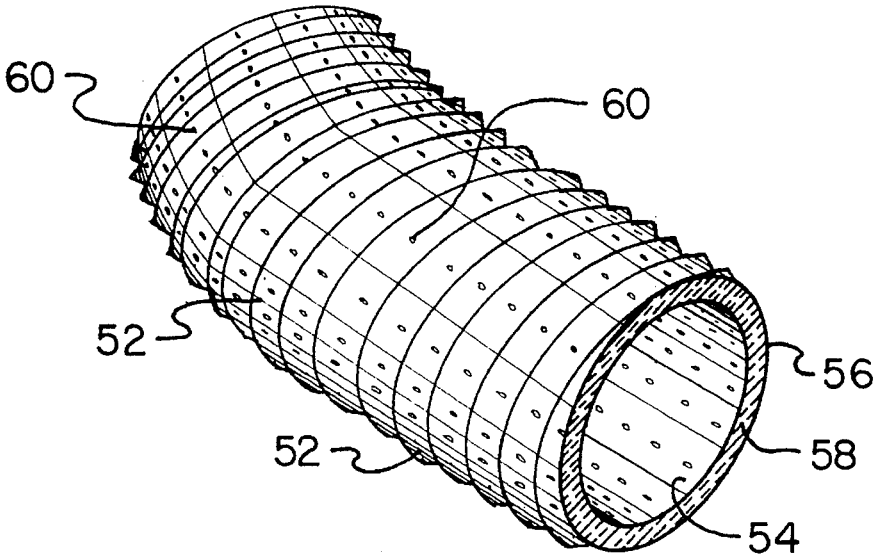
FIG. 6 an enlarged perspective view of the flexible light conveyance shown in FIG. 1 that extends from the roof-mounted skylight to the ceiling-mounted translucent fixture.

As shown in FIG. 6, the flexible, tubular light conveyance module 20 includes a plurality of microperforations 60 which permit moisture to escape from an interior portion of the flexible, tubular light conveyance module 20.

The cross-sectional shape of the flexible, tubular light conveyance module 20 can be circular or polygonal, e.g. rectangular. In this respect, the cross-sectional shape of the distal end portion 34 of the roof-traversing assembly 30 of the roof-mounted skylight module 12 is complementary to the cross-sectional shape of the flexible, tubular light conveyance module 20. Similarly, the cross-sectional shape of the free distal end portion 36 of the ceiling-mounted translucent fixture module 16 is complementary to the cross-sectional shape of the flexible, tubular light conveyance module 20.

The flexible, tubular light conveyance module 20 is connected between the roof-mounted skylight module 12 and the ceiling-mounted translucent fixture module 16 and permits light from outside the roof 11 to be transmitted through the translucent cap assembly 22, through the cap-receiving assembly 24, through the roof-traversing assembly 30, through the flexible, tubular light conveyance module 20, through the free distal end portion 36, through the transition portion 44, and through the ceiling-traversing assembly 42 of the ceiling-mounted translucent fixture module 16 into the room 13. This is so whether the roof-mounted skylight module 12 is placed directly above the ceiling-mounted translucent fixture module 16 or at a position skewed from the ceiling-mounted translucent fixture module 16. This is also so when the roof-mounted skylight module 12 is placed on a sloped roof, and the ceiling-mounted translucent fixture module 16 is installed in a horizontal ceiling.

The flexible, tubular light conveyance module 20 can be provided at a predetermined length when used in a kit. The length can be sufficiently long to be suitable for many diverse applications. At the site of installation, the length of the flexible, tubular light conveyance module 20 can be cut for a particular application. The kit of the invention can also include a standard roof-mounted skylight module 12 and a standard ceiling-mounted translucent fixture module 16 that readily connect with the flexible, tubular light conveyance module 20.

In using the roof to ceiling skylight apparatus 10 of the invention, a roof aperture 14 is cut out in the roof 11, and a ceiling aperture 18 is cut out in the ceiling 21. A flashing curb assembly 23 is placed around the roof aperture 14, and the roof-mounted skylight module 12 is installed in the roof aperture 14 by inserting the roof-traversing assembly 30 through the roof-traversing assembly 30 through the roof aperture 14. The roof-mounted skylight module 12 secures the flashing curb assembly 23 in position on the roof 11. The ceiling-mounted translucent fixture module 16 is installed in the ceiling aperture 18 by pushing the free distal end portion 36 of the ceiling-mounted translucent fixture module 16 through the ceiling aperture 18 from the room 13. The ceiling-mounted translucent fixture module 16 is secured with respect to the ceiling 21 by either fasteners or a retention flange assembly 38. Then a pleated flexible, tubular light conveyance module 20 is installed between the distal end portion 34 of the roof-mounted skylight module 12 and the free distal end portion 36 of the ceiling-mounted translucent fixture module 16.

More specifically, the pleated flexible, tubular light conveyance module 20 fits over the ridges 48 on the roof-mounted skylight module 12 and the ridges 50 on the ceiling-mounted translucent fixture module 16. Strings, ropes, or other thin flexible materials can be used to tie around the flexible, tubular light conveyance module 20 and secure the respective ends of the flexible, tubular light conveyance module 20 to the respective roof-mounted skylight module 12 and the respective ceiling-mounted translucent fixture module 16. The pleated flexible, tubular light conveyance module 20 can be stretched longitudinally and bent laterally to assume a wide variety of angles and distances between the roof-mounted skylight module 12 and the ceiling-mounted translucent fixture module 16. The inner wall portion 54 of the flexible, tubular light conveyance module 20 is very reflective and readily reflects light from the roof-mounted skylight module 12 to the ceiling-mounted translucent fixture module 16.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved roof to ceiling skylight apparatus that is low in cost, relatively simple in design and operation, and which may advantageously be used to provide insulation to a portion of the ceiling that receives light from the skylight. With the invention, a roof to ceiling skylight apparatus is provided which reduces the susceptibility of water leaks from a skylight into a room below the skylight. With the invention, a roof to ceiling skylight apparatus is provided which does not subject a room below a skylight to outdoor weather when a roof-mounted skylight is broken or subject to repairs. With the invention, a roof to ceiling skylight apparatus is provided which avoids the construction of a rigid, insulated light conveying shaft from a roof-mounted skylight to a ceiling-mounted translucent fixture. With the invention, a roof to ceiling skylight apparatus is provided which avoids the construction of angular bends in a rigid, insulated light conveying shaft constructed between a roof-mounted skylight that is not placed directly above a ceiling-mounted translucent fixture. With the invention, a roof to ceiling skylight apparatus is provided which avoids the construction of a rigid, insulated light conveying shaft between a sloped-roof-mounted skylight and a horizontal-ceiling-mounted translucent fixture. With the invention, a roof to ceiling skylight apparatus is provided which permits installation of a light conveyance between a roof-mounted skylight and a ceiling-mounted translucent fixture in much less time than installation of a rigid, insulated light conveying shaft. With the invention, a roof to ceiling skylight apparatus is provided which does not require painting of the light conveyance from the roof-mounted skylight to the ceiling-mounted translucent fixture. With the invention, a roof to ceiling skylight apparatus is provided which eliminates the need for a customized construction of a light conveyance between a roof-mounted skylight and a ceiling-mounted translucent fixture. With the invention, a roof to ceiling skylight apparatus is provided which provides a standardized skylight kit that includes a standardized light conveyance along with a standardized roof-mounted skylight and a standardized ceiling-mounted translucent fixture.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved roof to ceiling skylight apparatus for conveying light from outside a roof to inside a room, comprising:

a roof-mountable skylight module for mounting in a roof aperture and capable of receiving light from outside a roof, a ceiling-mountable translucent fixture module for mounting in a ceiling aperture and capable of conveying light to inside a room, and a flexible, tubular light conveyance module connecting said roof-mountable skylight module and said ceiling-mountable translucent fixture module and for conveying light received from outside the roof, through said roof-mountable skylight module, through said flexible, tubular light conveyance module, through said ceiling-mountable translucent fixture module, and to inside the room, wherein said roof-mounted skylight module includes:

a translucent cap assembly, a cap-receiving assembly supporting said translucent cap assembly, wherein said cap-receiving assembly includes an outer dimension which is greater than an inner dimension of the roof aperture in which said skylight module assembly is mountable, and a roof-traversing assembly supporting said cap-receiving assembly, and wherein said roof-traversing assembly includes a free distal end portion connecting to said flexible, tubular light conveyance module.

2. The apparatus descried in claim 1 wherein said distal end portion of said roof-traversing assembly includes a plurality of ridges connecting said roof-traversing assembly to said flexible, tubular light conveyance module.

3. The apparatus described in claim 1 wherein said ceiling-mountable translucent fixture module includes:

a ceiling-traversing assembly for fitting into said ceiling aperture, and a free distal end portion connecting to said ceiling-traversing assembly.

4. The apparatus described in claim 3 wherein said free distal end portion of said ceiling-mountable translucent fixture module includes a plurality of ridges connecting said ceiling-mounted translucent fixture module to said flexible, tubular light conveyance module.

5. The apparatus described in claim 4, further including:

a transition portion connected between said ceiling-traversing assembly and said free distal end portion of said ceiling-mounted translucent fixture module.

6. The apparatus described in claim 1 wherein said flexible, tubular light conveyance module includes a plurality of pleats which facilitate bending of said flexible, tubular light conveyance module.

7. The apparatus described in claim 1 wherein said flexible, tubular light conveyance module includes:

an inner wall portion, an outer wall portion, and a quantity of an insulation material located between said inner wall portion and said outer wall portion.

8. The apparatus described in claim 7 wherein said inner wall portion of said flexible, tubular light conveyance module is white to facilitate light reflection within said flexible, tubular light conveyance module from said inner wall portion.

9. The apparatus descried in claim 7 wherein said insulation material includes injected foam material.

10. The apparatus described in claim 1 wherein said flexible, tubular light conveyance module includes a plurality of microperforations which permit moisture to escape from an interior portion of said flexible, tubular light conveyance module.

* * * * *